United States Patent [19]

Benedum et al.

[11] 4,146,094

[45] Mar. 27, 1979

[54] TUBULAR ONE-WAY CLOSURE FOR INJECTING A MATERIAL INTO A HOLE

[75] Inventors: Walter Benedum, Essen; Otto-Ernst Glaesmann, Dortmund; Walter Marsch, Recklinghausen, all of Fed. Rep. of Germany

[73] Assignee: Bergwerksverband GmbH, Essen, Fed. Rep. of Germany

[21] Appl. No.: 740,320

[22] Filed: Nov. 9, 1976

[30] Foreign Application Priority Data

Nov. 11, 1975 [DE] Fed. Rep. of Germany ..... 2550555

[51] Int. Cl.[2] ..... E21B 23/00

[52] U.S. Cl. ..... 166/133; 166/139

[58] Field of Search ..... 166/133, 139, 196, 216, 166/140, 130, 219; 141/311 R; 249/109; 61/45 B

[56] References Cited

U.S. PATENT DOCUMENTS

| | | | |
|---|---|---|---|
| 904,202 | 11/1908 | Heeter | 166/139 |
| 1,136,904 | 4/1915 | Stinson | 166/139 X |
| 2,139,983 | 12/1938 | Stone | 166/133 |
| 2,383,453 | 8/1945 | Crickmer | 166/216 |
| 2,531,791 | 11/1950 | Silvey | 166/139 |
| 2,825,410 | 3/1958 | Brown | 166/139 |
| 3,256,437 | 6/1966 | Muse | 166/139 |
| 3,695,045 | 10/1972 | Williams | 61/45 B |
| 3,908,386 | 9/1975 | Williams | 61/45 B |
| 3,986,536 | 10/1976 | Janson | 141/311 R |

*Primary Examiner*—Ernest R. Purser
*Assistant Examiner*—Richard E. Favreau
*Attorney, Agent, or Firm*—Michael J. Striker

[57] ABSTRACT

A tubular one-way closure for injecting a material, particularly synthetic plastic foam material, into a hole has a throttle channel through which the material is to be injected, and a central tube rotatable about its axis and movable in its axial direction. The closure also comprises an expandable anchoring member actuated by said central tube so as to anchor said closure in said hole while being expanded, and an elastic sealing member also actuated by said central tube so as to seal said hole after anchoring of the same.

14 Claims, 1 Drawing Figure

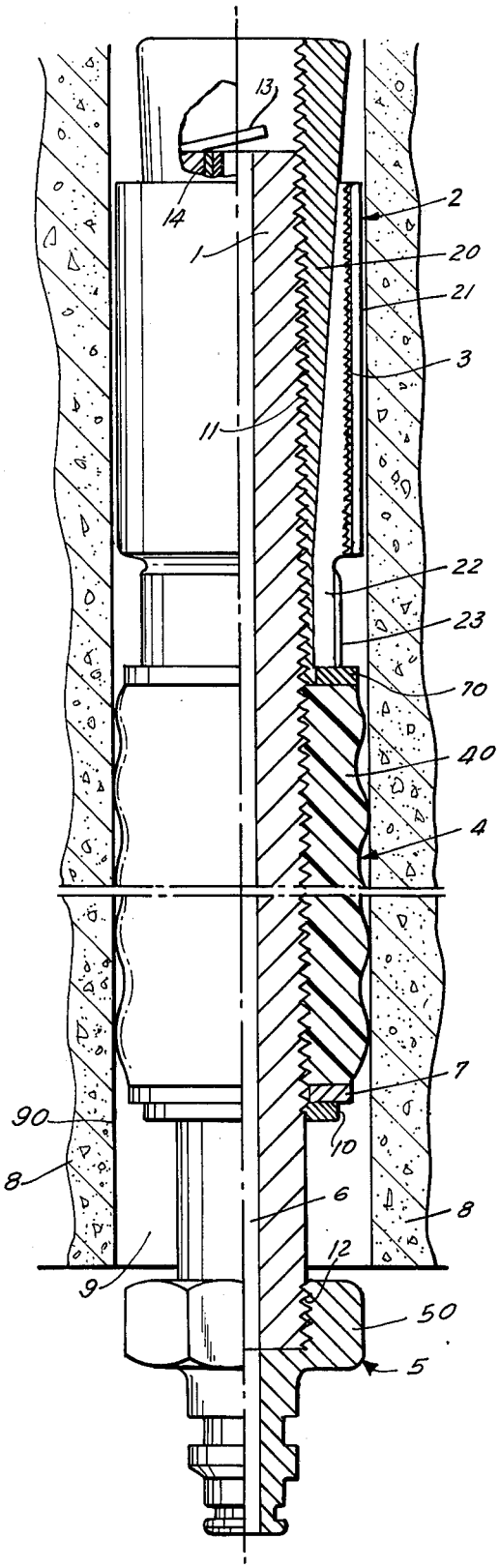
13
14
1
2
20
21
3
11
22
23
10
40
4
7
90
10
8
6
8
12
9
50
5

TUBULAR ONE-WAY CLOSURE FOR INJECTING A MATERIAL INTO A HOLE

BACKGROUND OF THE INVENTION

The present invention relates to a closure for injecting a material into a hole. More particularly it relates to a tubular one-way closure for injecting synthetic plastic foam material in a drill hole, which closure comprises a throttle channel through which a material is to be injected, a central tube and an elastic tubular sealing member mounted on said central tube.

Closures of this general type have already been proposed. In such a closure an annular internal recess is provided between the central tube and the elastic tubular member, which recess communicates with a through hole in the central tube. The above mentioned internal recess is filled with components of synthetic plastic material, the volume of the thus-filled internal recess is increased and the elastic tubular member is pressed against an inner surface of the drill hole so as to seal the same.

This construction of the closure possesses some disadvantages.

The elastic tubular member serves as the only means for both sealing of the drill hole and anchoring of the closure in the drill hole. In order to perform a sealing action the sealing member must be constituted of a highly elastic material, and therefore such member can not ensure a sufficient anchoring action, which in turn permits undesirable slippage of the closure relative to the inner surface of the drill hole.

It is also possible in this construction that during the filling of the ring-shaped recess only one of the components of the synthetic material enters the recess, with the result that a sufficient expansion of the elastic tubular member can not be obtained. After the injection into a drill hole, the mixing chamber of a pressure pump used for the purpose is cleaned out to remove the synthetic material and prevent hardening of the same in the mixing chamber. For injecting into the next drill hole, the mixing chamber and feeding conduits must be cleaned of said component before dispensing a multicomponent mixture. This moment of time can not be easily fixed which also causes certain difficulties.

Furthermore, pressure produced by foam material and exerted on the elastic member is not sufficient to anchor the closure in a drill hole having a smooth internal surface. This can also result in slippage of the closure relative to the internal surface of the drill hole.

A closure is also known which is glued in the drill hole with synthetic plastic foam material by means of a special operation. This has the disadvantage that an additional loss of time and a separate operation are required. The gluing is carried out in a zone adjacent to a mouth of the drill hole. However, it is desirable to anchor the closure at such a depth that the material to be injected will not be located adjacent an inlet part of the drill hole in the outer area of a longitudinal wall.

The above-mentioned constructions of the closure can be found, for example, in German Pat. Nos. 2,402,509 and 2,205,823.

SUMMARY OF THE INVENTION

Accordingly, it is an object of the present invention to provide an improved tubular one-way closure for injecting a material into a hole, which avoids the aforementioned disadvantages.

More particularly, it is an object of the invention to provide an improved closure which ensures sufficient anchoring of the closure in the drill hole having a smooth internal surface and also sufficient sealing of the drill hole after the anchoring of the closure therein.

Another object of the present invention is to provide an improved closure which can be anchored in and can seal the drill hole easily and quickly without the loss of additional time or the requirement for carrying out an additional operation.

In keeping with these objects, and with others which will become apparent hereafter, the closure for injecting a material into a hole, in accordance with the present invention, briefly stated, comprises a throttle channel through which the material is to be injected; a central tube rotatable about its axis and movable in its axial direction; an expandable anchoring member actuated by the central tube so as to anchor the closure in the hole while being expanded; and an elastic sealing element also actuated by the central tube so as to seal the hole against escape of the material about the closure after anchoring of the same.

The anchoring member comprises an expandable outer shell having an inner conical surface, and an inner actuating member having an outer conical surface slidable over the inner surface of the expandable outer shell. The inner actuating member is threadedly engaged with the outer surface of the central tube so that, during rotating of the latter about its axis, the inner actuating member is moved in the axial direction and expands the expandable outer shell in a radial direction by means of interaction of the conical surfaces, and thereby provides the anchorage of the closure in the hole.

The sealing member has two side surfaces spaced in the axial direction. The central tube has a flange member fixedly connected thereto and adapted while being moved in the axial direction with the central tube to press onto a first of the side surfaces of the sealing member which second surface is supported by an end part of the outer shell of the anchoring member. Thus, the sealing member is compressed in the axial direction and expanded in the radial direction which results in sealing of the hole.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

BRIEF DESCRIPTION OF THE DRAWING

The single FIGURE is a partially sectioned side elevational view of a tubular one-way closure in accordance with the present invention.

DESCRIPTION OF THE PREFERRED EMBODIMENT

As clearly shown in the FIGURE, a tubular one-way closure in accordance with the invention comprises a central tube 1 provided with a flange member 10 fixedly connected thereto. In the illustrated embodiment a flange member 10 threadedly engages a threaded part 11 of the central tube 1. A sealing member 4 is provided which is supported by the flange member 10. The sealing element 4 has a tubular part 40 of elastic material, preferably of rubber with a Shore Hardness equal to between 30 and 40 and with textile protective fabric, and two sliding discs 7 and 70 mounted on the central tube with play between the discs and the central tube. The tubular part 40 of the sealing member 4 is located intermediate the discs 7 and 70.

An anchoring member 2 is located adjacent to the sliding disc 70 and comprises an inner expanding cone threadedly engaged with the threaded part 11 of the central tube 1 and an outer expandable shell 21. The inner surface of the expandable shell 21 slidably engages with the outer surface of the expanding cone 20. In the illustrated embodiment the outer shell 21 has an end part 22 embraced by a holding band 23. An equalizing layer 3 of elastic material can be mounted on the outer surface of the expandable shell 21, that is especially desirable when the closure is used in a drill hole 9 made in a broken rock 8. The equalizing layer 3 prevents escape of the injected material through loosened portions of the rock and ensures the anchorage of the anchoring member 2 in a drill hole 9. The equalizing layer 3 is preferably constituted of rubber with a Shore Hardness equal to between 30 and 40.

A tightening element 5 is also provided for tightening the anchoring member 2 against the internal wall 90 of the drill hole 9. In the embodiment shown this element is configurated as a screw nipple 50 threadedly engaged with a threaded part 12 of the central tube 1, which screw nipple also serves as a connecting element for a feeding conduit.

The central tube 1 can be configurated over its entire length as a throttle channel 6. In this case the inner diameter of the central tube is kept so narrow that it permits feeding of a fluid mixture into the drill hole, but prevents discharging of the expanded foam from the same.

The central tube 1 also can be provided with a check valve 13 with a spring element 14, shown in the drawing by the broken lines, which prevents a back flow of the foam. The spring element 14 urges the valve to a closed position. During injection, injected material overcomes stress of the spring element 14 and flows through the open valve 13, whereas thereupon the spring element 14 closes the valve 13 and therefore backflow of the foam is prevented.

The tubular one-way closure, in accordance with the present invention, operates as follows:

After introducing the closure into the drill hole the central tube, by operating of the tightening element 5, is screwed into the inner thread of the expanding cone 20 of the anchoring member 2. The expanding cone is moved in an axial direction and presses onto the expandable shell 21 by means of the interaction of their conical surfaces with one another. Since the expandable shell 21 abuts on the sliding disc 70 of the sealing member 4 and can not move in the axial direction, it expands in a radial direction so as to be pressed against the internal surface of the drill bore. The expandable shell 21 expands easily at the beginning, since it is loosely mounted on the expanding cone 20. The expandable shell 21 does not rotate at the beginning due to its inertia. It also does not rotate later, because then it comes into contact with irregularities of the wall of the drill hole which prevent its rotation. The tubular part 40 of the sealing element is supported by the sliding disc 7, which abuts on the flange member 10, and kept immovable until the expandable shell 21 has become anchored in the drill hole. Expanding of the tubular part 40 of the sealing member starts only after anchoring of the closure in the drill hole. After the expanding of the expandable shell 21 and the anchoring of the same on the wall of the drill hole, rotating of the central tube 1 is continued which results in screwing of the central tube 1 into the expanding cone 20 and movement in the axial direction toward the anchoring member 2. The flange member 10 fixedly connected to the central tube 1 moves together with the same in this direction and presses onto the sliding disc 7 of the sealing element 4. The latter, supported on the other side thereof by the sliding disc 70 abutting on the end part 22 of the anchoring element, is compressed in the axial direction by the flange member 10 and expanded in the radial direction. At the beginning it can be obtained that the expanding of the anchoring element 2 and the expanding of the sealing element 4 are performed alternately, whereby one of the elements serves as a support for the other. The thus expanded sealing element 4 seals the drill hole.

The tubular one-way closure, in accordance with the present invention, provides for highly advantageous results. The construction of the closure ensures the sufficient anchorage of the same in the smooth drill hole and thereafter ensures sufficient sealing of the hole against escape of the injected material about the closure. The closure is anchored in and seals the drill hole easily and quickly without any loss of time or the need for carrying out any additional operations.

It will be understood that each of the elements described above, or two or more together, may also find a useful application in other types of constructions differing from the types described above.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A tubular one-way closure for injecting a material, particularly synthetic plastic foam material, into a hole, comprising a central tube having a front section and a rear section and a passage through which material is to be injected; means for drawing said tube axially into the hole in response to rotation of said tube about its longitudinal axis, including an expandable annular anchoring member surrounding a portion of said tube; a shoulder on said rear section of said tube; and an elastic annular sealing member surrounding said tube intermediate said anchoring member and said shoulder so as to be axially compressed in response to axial advancement of the tube into said hole.

2. A closure as defined in claim 1, wherein said central tube is configurated so as to bound said passage over the entire length thereof.

3. A closure as defined in claim 1, wherein said elastic sealing member is constituted of rubber with a Shore Hardness equal to between 30 and 40.

4. A closure as defined in claim 1, wherein said central tube is provided with a check valve adapted to prevent a back flow of said material through said throttle channel.

5. A closure as defined in claim 1, wherein said sealing member has two end surfaces spaced in said axial direction from one another, said central tube having a flange member fixedly connected thereto and adapted while being moved in said axial direction together with said central tube to exert pressure upon a first one of said end surfaces of said sealing member.

6. A closure as defined in claim 1, wherein said central tube has a leading end and a trailing end; and further comprising a rotating element for rotating said tube and thereby causing tightening of said anchoring member against the internal wall of said hole, said rotating element being configurated as screw nipple and threadedly engaged with said trailing end of said central tube.

7. A closure as defined in claim 1, wherein said anchoring member comprises an expandable outer shell; and further comprising an inner actuating member engaged with said central tube so as to expand said expandable outer shell while being moved by rotation of said central tube.

8. A closure as defined in claim 7, wherein said expandable outer shell has an inner conical surface, said actuating inner member having an outer conical surface slidable over said inner conical surface of said expandable outer shell, said actuating inner member being threadedly engaged with an outer surface of said central tube so as during rotation of the latter about said axis said actuating inner member is moved in said axial direction and expands said expandable outer shell in a radial direction by means of interaction of said conical surfaces to thereby provide anchorage of said closure in said hole.

9. A closure as defined in claim 1, wherein said anchoring member comprises an expandable outer shell which has an end part adjacent a second of two end surfaces of said sealing member, said end part being adapted to prevent displacement of said sealing member in said axial direction under pressure exerted thereon by said shoulder and thereby to assure compressing of said sealing member in said axial direction and expanding of the same in a radial direction resulting in sealing of said hole.

10. A closure as defined in claim 9, further comprising a holding band embracing an outer surface of said end part of said expandable outer shell of said anchoring member.

11. A closure as defined in claim 9, further comprising two sliding rings embracing said central tube with play therebetween and each abutting on a respective one of two end surfaces of said sealing member.

12. A closure as defined in claim 11, wherein one of said sliding rings is located intermediate said end part of said expandable outer shell of said anchoring member and said second end surface of said sealing member, and the other of said sliding rings being located intermediate said first end surface of said elastic sealing member and said shoulder of said central tube.

13. A closure as defined in claim 9, further comprising an equalizing layer mounted on an outer surface of said expandable outer shell of said anchoring member and constituted of elastic material.

14. A closure as defined in claim 13, wherein said equalizing layer is constituted of rubber with a Shore Hardness equal to between 30 and 40.

* * * * *